US006796536B1

(12) United States Patent
Sevier, IV

(10) Patent No.: US 6,796,536 B1
(45) Date of Patent: Sep. 28, 2004

(54) COMPUTER SUPPORT APPARATUS AND METHOD

(75) Inventor: Landers Sevier, IV, Birmingham, AL (US)

(73) Assignee: Ebsoo Media, Inc., Birmingham, AL (US)

( * ) Notice: Subject to any disclaimer, the term of this patent is extended or adjusted under 35 U.S.C. 154(b) by 0 days.

(21) Appl. No.: 10/234,815

(22) Filed: Sep. 4, 2002

(51) Int. Cl.[7] ..... F16L 3/00

(52) U.S. Cl. ..... 248/121; 248/124.1; 248/125.8; 248/919; 248/924

(58) Field of Search ..... 248/121, 919, 248/920, 921, 923, 924, 122.1, 124.1, 125.9, 125.7, 178.1, 181.1; 108/44

(56) References Cited

U.S. PATENT DOCUMENTS

| | | | | | |
|---|---|---|---|---|---|
| 790,217 | A | | 5/1905 | Mason | |
| 1,797,847 | A | | 5/1931 | Vandagriff | |
| 2,193,647 | A | | 3/1940 | Rush et al. | 311/27 |
| 3,351,312 | A | | 11/1967 | Ballas | 248/448 |
| 3,889,914 | A | | 6/1975 | Torme | 248/445 |
| 4,508,307 | A | * | 4/1985 | Morales | 248/460 |
| 4,638,969 | A | * | 1/1987 | Brown | 248/122.1 |
| 4,826,123 | A | * | 5/1989 | Hannah et al. | 248/248 |
| 4,844,387 | A | * | 7/1989 | Sorgi et al. | 108/5 |
| 4,848,710 | A | | 7/1989 | Newman | 248/129 |
| 4,852,500 | A | * | 8/1989 | Ryburg et al. | 108/105 |
| 4,854,538 | A | * | 8/1989 | Von Schalscha | 248/346.03 |
| 4,946,120 | A | * | 8/1990 | Hatcher | 248/183.2 |
| 5,108,063 | A | | 4/1992 | Koerber, Sr. et al. | 248/284 |
| D325,868 | S | * | 5/1992 | Bartok | D8/380 |
| 5,207,405 | A | * | 5/1993 | Cobb | 248/411 |
| 5,263,423 | A | * | 11/1993 | Anderson | 108/43 |
| 5,275,482 | A | * | 1/1994 | Grant | 312/235.9 |
| D347,841 | S | * | 6/1994 | Rossman et al. | D14/452 |
| 5,429,337 | A | * | 7/1995 | Poole | 248/442.2 |
| 5,485,793 | A | * | 1/1996 | Crowell | 108/44 |
| 5,553,824 | A | * | 9/1996 | Dutra, Jr. | 248/346.07 |
| 5,590,607 | A | | 1/1997 | Howard | 108/98 |
| 5,595,074 | A | * | 1/1997 | Munro | 70/58 |
| 5,615,856 | A | * | 4/1997 | Simington | 248/452 |
| 5,623,869 | A | * | 4/1997 | Moss et al. | 108/43 |
| 5,630,566 | A | | 5/1997 | Case | 248/122.1 |
| 5,642,541 | A | | 7/1997 | Corbin | 5/507.1 |
| 5,673,628 | A | * | 10/1997 | Boos | 108/44 |
| 5,769,369 | A | * | 6/1998 | Meinel | 248/176.1 |
| 5,799,917 | A | * | 9/1998 | Li | 248/284.1 |
| 5,971,344 | A | * | 10/1999 | Ainsworth | 248/445 |
| 6,021,535 | A | | 2/2000 | Baus et al. | 5/632 |
| 6,021,720 | A | * | 2/2000 | Boos et al. | 108/44 |
| 6,076,787 | A | * | 6/2000 | Troyer | 248/166 |
| 6,113,050 | A | * | 9/2000 | Rush | 248/346.01 |
| 6,123,309 | A | * | 9/2000 | Sage | 248/316.1 |
| 6,213,438 | B1 | * | 4/2001 | Ostby et al. | 248/276.1 |
| 6,236,571 | B1 | | 5/2001 | Dohi et al. | 361/727 |
| 6,382,580 | B1 | * | 5/2002 | Wisniewski | 248/316.4 |
| 6,394,402 | B2 | * | 5/2002 | Coonan et al. | 248/123.11 |
| 6,491,276 | B1 | * | 12/2002 | Belliveau | 248/372.1 |
| 2002/0017595 | A1 | * | 2/2002 | Koyanagi | 248/122.1 |
| 2003/0042373 | A1 | * | 3/2003 | MacLeod | 248/125.1 |

OTHER PUBLICATIONS

Copy of brochure of Laptop Hold Down from Protex International Corp.

* cited by examiner

*Primary Examiner*—Leslie A. Braun
*Assistant Examiner*—Naschica S. Morrison
(74) *Attorney, Agent, or Firm*—Waddey & Patterson, P.C.; Larry W. Brantley

(57) ABSTRACT

A system for mounting a laptop computer on a mobile casterized base, comprising: an articulated arm having a first end and a second end, the first end being adjustably connected to the mobile casterized base; and a bracket assembly adjustably connected to the second end of the articulated arm for securely retaining the laptop computer, the bracket assembly being adjustable in at least one dimension to securely retain the laptop computer.

10 Claims, 9 Drawing Sheets

COMPUTER SUPPORT APPARATUS AND METHOD

Be it known that I, Landers Sevier IV, a citizen of the United States, residing at 3726 Montrose Road, Birmingham, Ala. 35213; have invented a new and useful "Computer Support Apparatus and Method."

A portion of the disclosure of this patent document contains material that may be subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

BACKGROUND OF THE INVENTION

Although personal computers have only been available to the public for slightly over twenty years, personal computing has become a pervasive part of most people's lives. As computer technology has allowed for the manufacturing of computers of increasing power and decreasing size, personal computers or "laptop" computers have become increasingly used by those who use a computer in various places. The emergence of email and the Internet have also provided ways for both stationary and mobile computer users to interact regardless of the distance between communicators.

Over a much longer period of time, people who are confined to a bed such as a hospital or sick bed have desired to continue working, communicating with others, or performing tasks of leisure. Various devices have been made, and some have been patented, that allow the bedridden to read, eat or drink, or even use certain kinds of computers. One such patent, U.S. Pat. No. 2,193,647, was issued for a bed frame-mounted tray that may hold a book or magazine in an inverted position so that a bedridden person could read while lying in bed. Not only was this invention connected to the bed of the person using the tray, it did not provide for the attachment of a computer of any kind in any useful fashion. Indeed, computers were unknown when U.S. Pat. No. 2,193,647 was issued.

Another relevant patent is U.S. Pat. No. 4,848,710, directed to a device for supporting a computer so that one may use the computer while lying on a bed. This patent does support a computer on a support system independent of the bed, but the support system is on casters on top of the bed so that the entire device must be surrounding the person using the device, which requires a considerable amount of work to situate. Also, the device does not allow the computer supported thereon to be inverted; a user of the device needs to be propped up in order to access the computer. Finally, the patented invention is not directed to an apparatus for supporting a laptop computer; the patented device is thus very cumbersome to use.

Finally, U.S. Pat. No. 5,630,566 was issued for a portable ergonomic workstation that articulates to a user's position. Although a disabled person confined to a bed is contemplated by the inventor of that invention, the patented invention does not allow for the utilization of a computer support apparatus that employs components that are already common to the environments in which they are used, such as the tray stands in a hospital.

What is needed, then, is a system for supportably mounting a portable computer, such as a laptop computer, so that the computer may be usably presented to a user who is bedridden, especially where the system employs an articulating arm extending from an installed base upon which the computer is mounted.

SUMMARY OF THE INVENTION

The present invention generally relates to an apparatus for supporting a portable computer. More specifically, the present invention relates to a system for supportably mounting a portable computer on a base, the portable computer being movable to a bedded person's position via an articulating arm.

In its most basic form, the portable computer support of the invention involves an articulated arm adjustably connected to a mobile casterized base, and a portable computer retaining means attached to the second end of the articulated arm. The articulated arm has one or more joints that allow the arm to position a portable computer so that a user lying in a bed can use the computer, and the arm should be able to be locked into position in front of the user so that the computer will not be allowed to be easily pushed away during use.

The portable computer support means may be any configuration that holds a computer in such a manner that the computer may be rotated from a first position in which the computer is accessible to a sitting or standing person, to a second position in which the computer screen and keyboard are presented toga user who is lying in a supine position.

Accordingly, it is an object of the present invention to provide a system for stably supporting a portable or laptop computer.

It is a further object of the invention to provide a system for mounting a portable or laptop computer to a mobile base.

It is a further object of the invention to provide a system for presenting a portable or laptop computer to a person who is supine.

It is a further object of the invention to provide a system for articulating a portable or laptop computer to a person who is bedridden in any manner.

In addition to the foregoing, further, objects, features, and advantages of the present invention should become more readily apparent to those skilled in the art upon a reading of the following detailed description in conjunction with the drawings, wherein there are shown and described illustrated embodiments of the invention.

DESCRIPTION OF THE PREFERRED EMBODIMENTS

Figure 1:
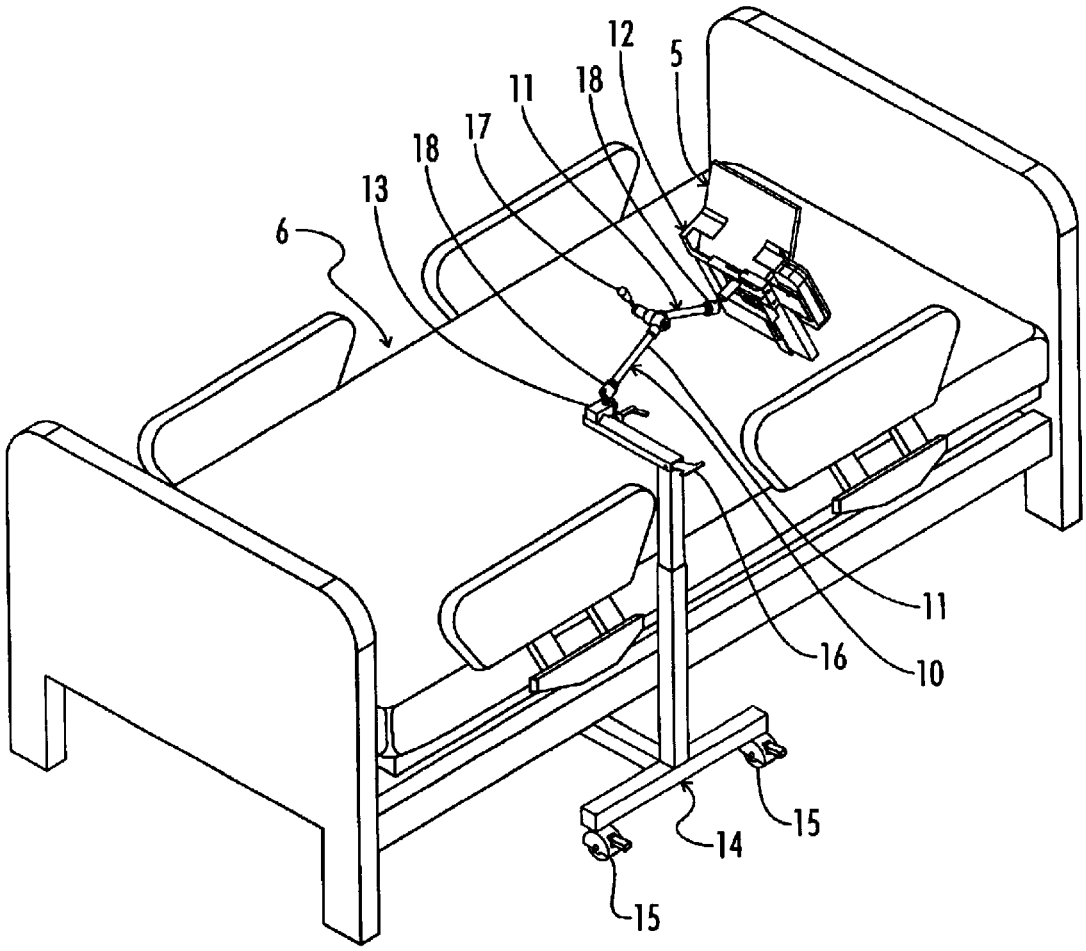
FIG. 1 is an isometric view of the computer support apparatus of the invention supporting a portable computer and placed in usable proximity to a bed.

Referring to FIG. 1, a portable computer 5 (the specific embodiment of portable computer 5 shown is a laptop computer) is positioned over a bed 6 (such as a hospital-type bed) using the system of the invention An articulated arm 10 having a pair of arm segments 11 is supported on a base 14. Base 14 is very similar to a known hospital tray base, and should include locking casters 15 on its lower end for allowing base 14 to be moved and/or secured against movement as the user desires. A lever 16 allows the top portion of base 14 to be adjustable in height in a manner that is well-known to those who make hospital tray stands. Articulated arm 10 is supported on base 14 via clamp 13 which may be secured at any position along the top of base 14 in the process of locating portable computer 5 in front of a user.

Further referring to FIG. 1, arm segments 11 are connected by a lockable knuckle joint 17 which allows arm segments 11 to rotate with respect to one another in a single plain towards or away from the user. A pair of ball-and-socket joints 18 are at opposite ends of articulated arm 10, one being on the end of articulated arm 10 adjacent clamp 13 and the second being on the end of articulated arm 10 adjacent portable computer 5. Ball-and-socket joints 18 allow for rotation in multiple dimensions and are lockable in place such that once portable computer 5 is positioned in front of a user, it may be secured against movement by the same mechanism that locks knuckle joint 17 against movement. Alternatively, ball-and-socket joints 18 could be replaced by knuckle joints similar to knuckle joint 17 without sacrificing the utility of the invention. Although portable computer 5 may be inverted so as to be effectively used by a bedridden or supine user, portable computer 5 is retained in place and secured to articulated arm 10 by a bracket assembly 12, which is adjustable to hold any of a variety of portable computers or laptop computers in such a manner to allow one who is resting in bed to comfortably use a computer.

Figure 2:
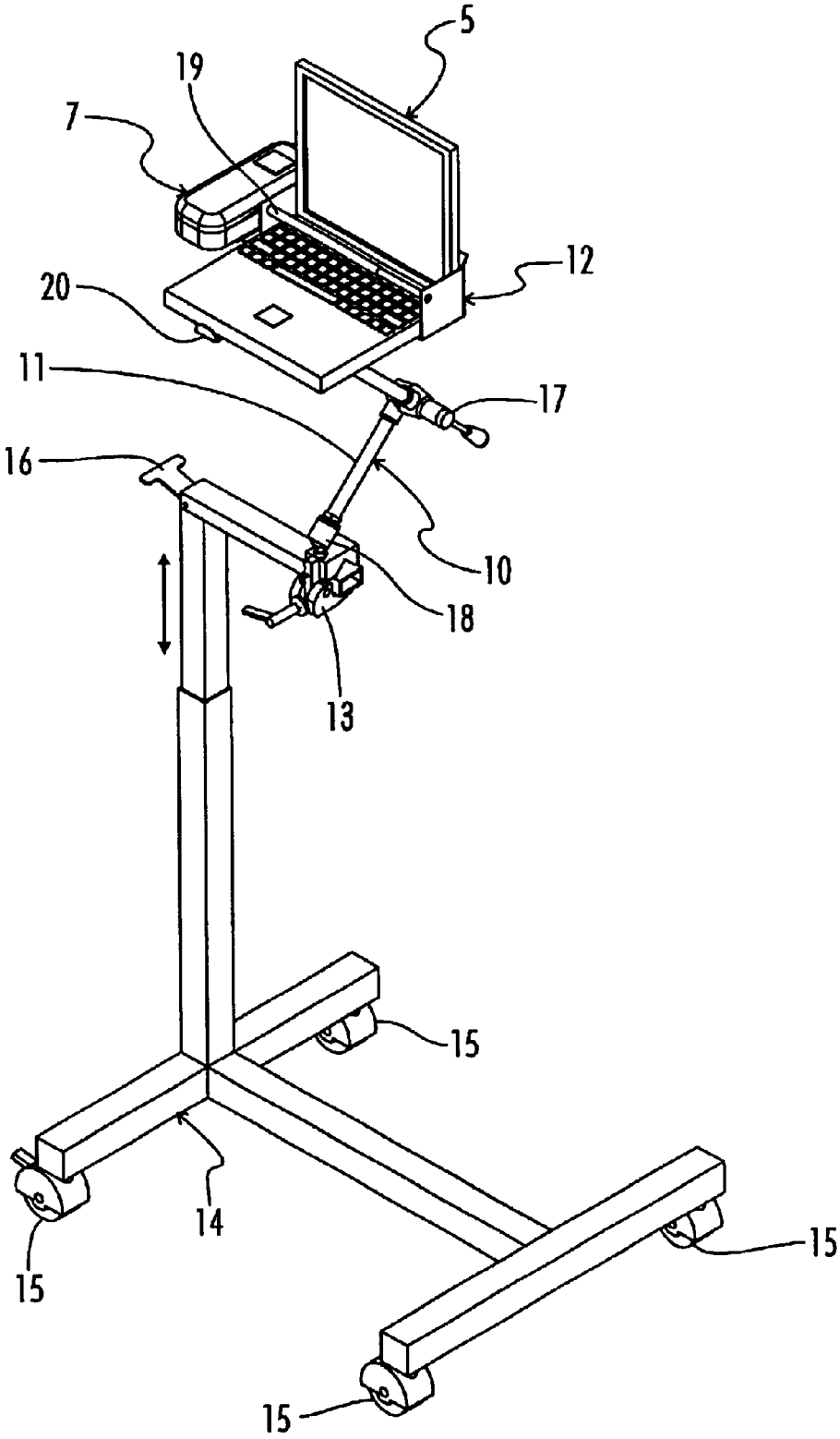
FIG. 2 is a frontal isometric view of the computer support apparatus of the invention supporting a portable computer and indicating height adjustability.

Referring to FIG. 2, a frontal perspective view of the system of the invention is shown with base 14 having lockable casters 15, base 14 further being height-adjustable by depressing and subsequently releasing lever 16 in a known manner. Articulated arm 10 is attached to the top of base 14 via lockable clamp 13, which may be positioned at any point along or adjacent to the top of base 14. Clamp 13 is connected to articulated arm 10 by ball-and-socket joint 18 that allows motion in multiple dimensions of arm segment 11. Both of arm segments 11 are connected together by a knuckle joint 17 which is lockable in place and when unlocked allows for rotational motion in a single plane varying the angle between arm segments 11.

Further referring to FIG. 2, articulated arm 10 supports bracket 12, which securely retains portable computer 5 therein primarily through the use of retaining rod 19. Retaining rod 19 is an adjustable-length rod that secures portable computer 5 against movement out of bracket 12 while portable computer 5 is inverted. Another feature of bracket 12 that aids retention of portable computer 6 is elongated tab 20, which is a long metal piece having an upturned flange. The up-turned flange engages a lower front portion of portable computer 5 to secure the computer against movement in that direction. A telephone 7 may also be mounted to bracket 12 as an enhanced version of the system of the invention.

Figure 3:
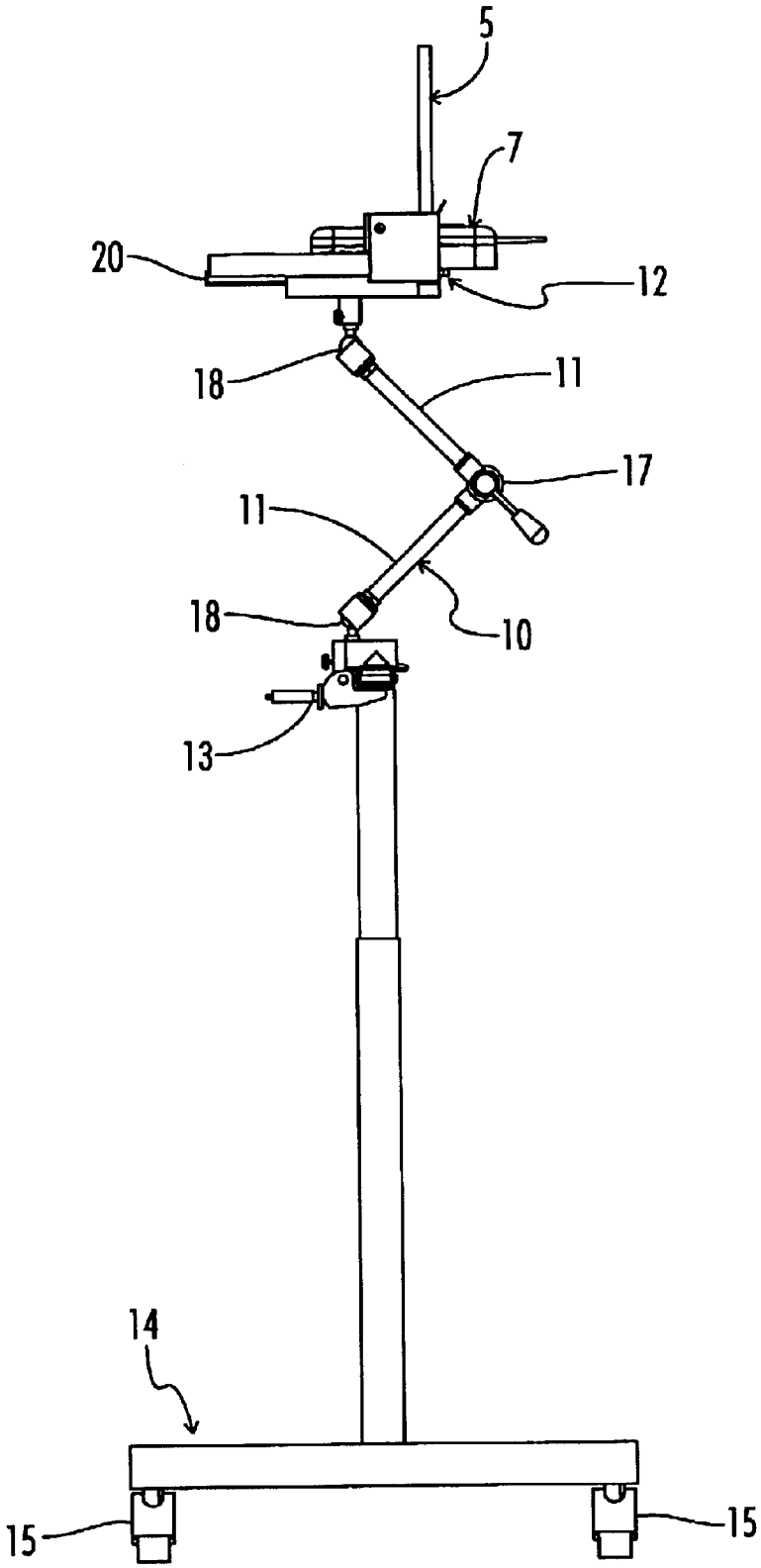
FIG. 3 is a side view of the computer support apparatus and supported computer of FIG. 2.

Referring to FIG. 3, base 14 is shown to be supporting articulated arm 10 width is clamped thereto by lockable clamp 13. Arm segments 11 engage eat other at knuckle joint 17. A first ball-and-socket joint 18 connects articulated arm 10 to lockable clamp 13 while a second ball-and-socket joint 18 connects articulated arm 10 to bracket 12. Bracket 12 secures portable computer 5 therein, and telephone 7 is supported thereon.

Figure 4:
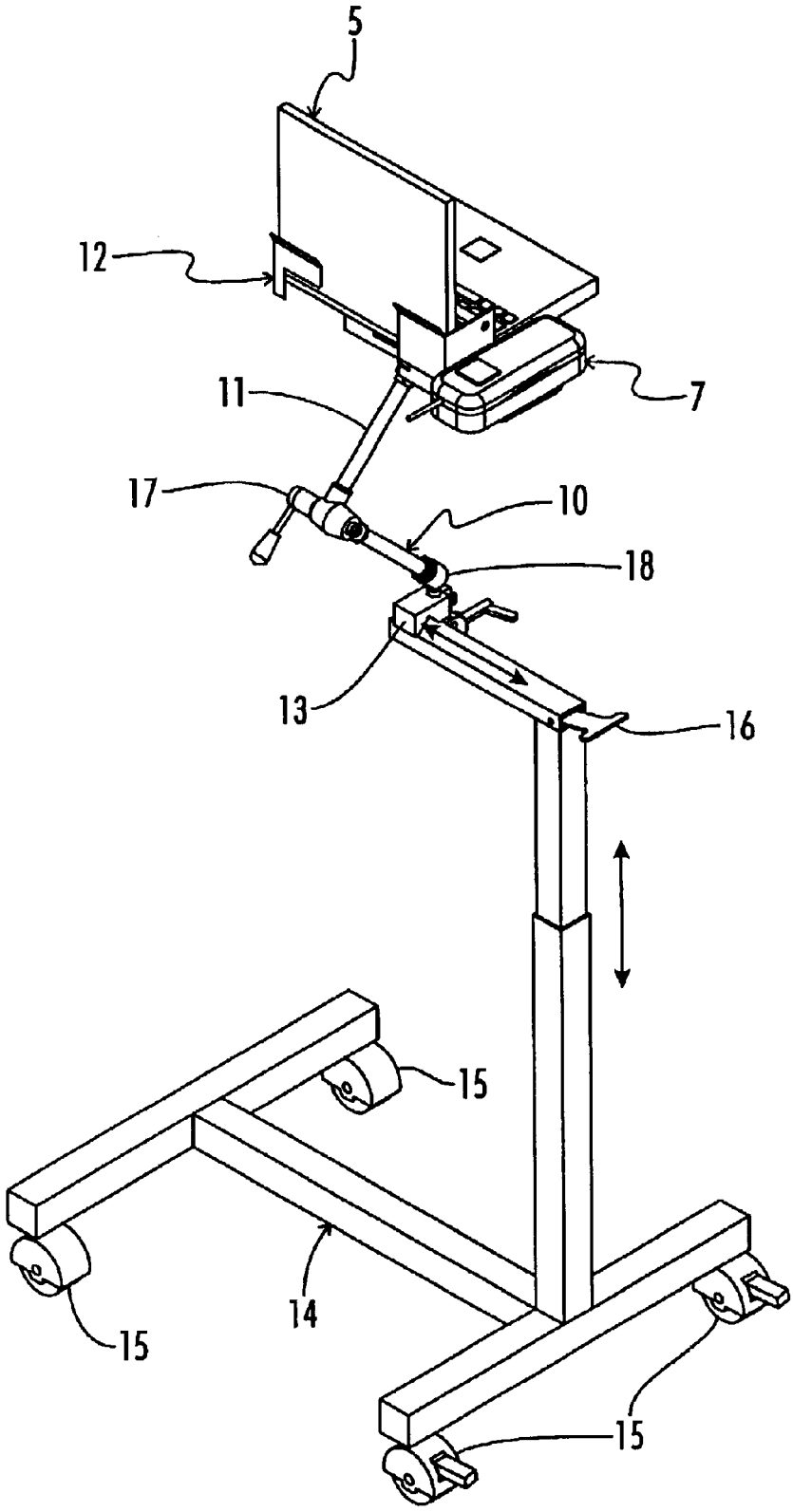
FIG. 4 is a rear isometric view of the computer support apparatus of the invention supporting a portable computer and indicating height adjustability.

Referring to FIG. 4, a rear view of the system of the invention indicates vertical and horizontal motion. Specifically, vertical motion of the system of the invention is achieved by depression and release of lever 16 in a known manner to raise and lower base 14. Articulated arm 10 may also be relocated horizontally along the top of base 14 by releasing and tightening clamp 13 at various positions along the top of base 14.

Figure 5:
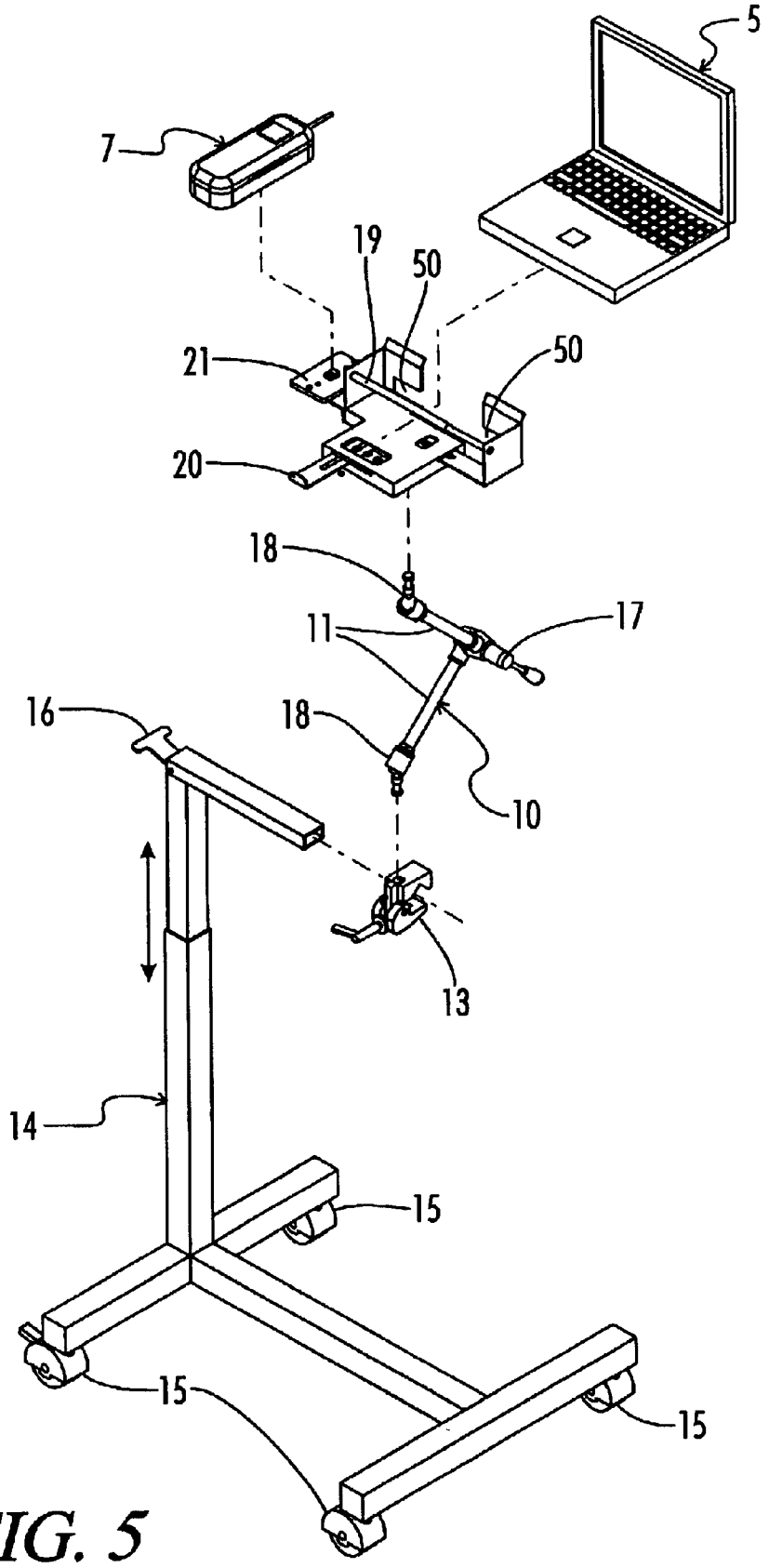
FIG. 5 is an exploded view of the computer support apparatus of FIG. 2.

Referring to FIG. 5, an exploded view of the system of the invention is shown with base 14 as described above, clamp 13 adjacent first ball-and-socket joint 18 which is connected to articulated arm 10. Arm segments 11 are adjustably connected together by lockable knuckle joint 17, and a second ball-and-socket joint 18 is connected at the end of articulated arm 10 opposite first ball-and-socket joint 18, positioned to be attached to bracket 12.

Articulated arm 10 is of a type that may be purchased from any of a variety of suppliers such as Bogen Photo Corporation of Ramsey, New Jersey. With this type of articulated arm 10, as knuckle joint 17 is locked in place ball-and-socket joints 18 are also locked, securing all joints of articulated arm 10 against movement which is an essential part of the preferred embodiment of the invention.

Further referring to FIG. 5, bracket 12 is adjustable in width and length to contain the lower portion of a portable or laptop computer. Bracket 12 has a pair of cutout portions 50 to ensure minimal interference with any power connections or other interfaces that may occur near the back area of portable computer 5. Retaining rod 19 is adjustable with the width of bracket 12 and secures the portable computer 5 against falling out when portable computer 5 is inserted therein. Similarly, elongated tab 20 is adjustable to the lower front portion of the portable computer so as to prevent portable computer 5 from slipping out during inverted use, while at the same time being minimal in size to avoid interfering with any disk drives or other connections that may be positioned near the front area of portable computer 5. Telephone platform 21 may also be added to bracket 12 for supporting a telephone 7 for use by the person using the portable computer 5. A wiring harness and remote power supply (not shown) may also be added to the system of the invention to allow a user of the invention to control the flow of the wiring to any conventional wall outlet as desired.

Figure 6:
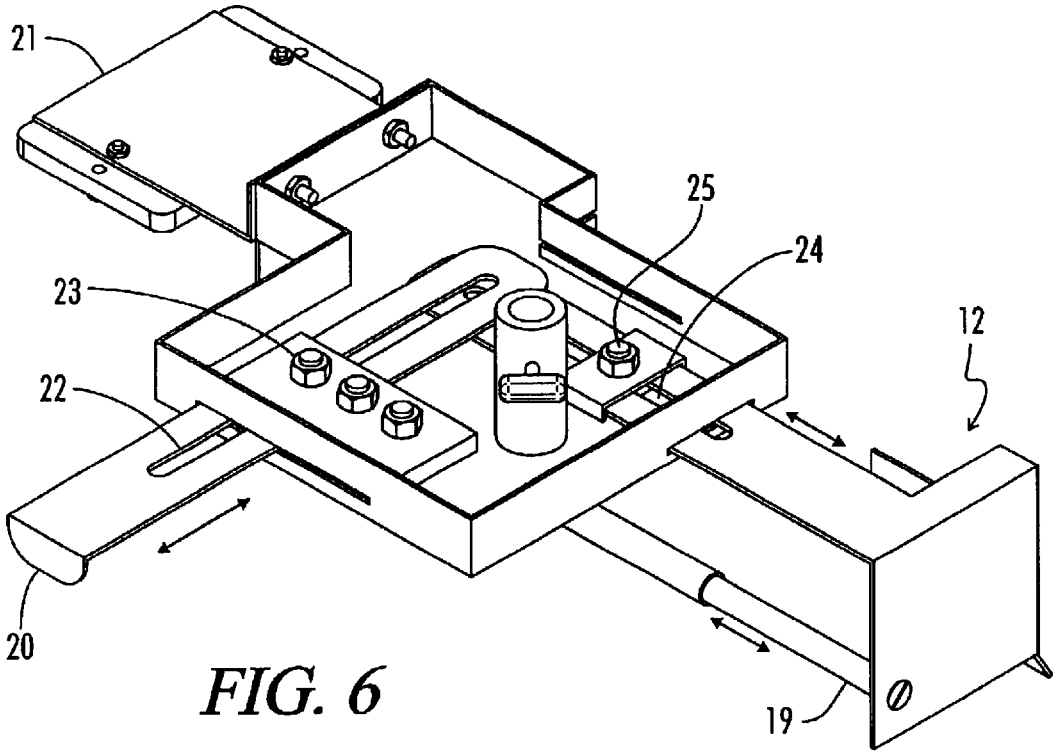
FIG. 6 is a bottom isometric view of the computer holding portion of the invention.

Referring to FIG. 6, a bottom perspective view of bracket 12 is shown indicating the directions in which bracket 12 is adjustable so as to allow bracket 12 to retain various-sized portable computers. As described above, elongated tab 20 is designed to adjustably engage the front lower portions of portable computers and is adjustable due to the positioning of a first slot 22 which is a slot that, when combined with first releasable fastener assembly 23 allows for adjustably securing elongated tab 20 in place. Similarly, a second slot 24 and second releasable fastener assembly 25 allow for the width of bracket 12 to be adjusted to the size of portable computers to be employed therein. Likewise, retaining rod 19 is able adjust to the width of bracket 12 as well. Platform 21 may be attached to bracket 12 in the manner described above.

Figure 7:
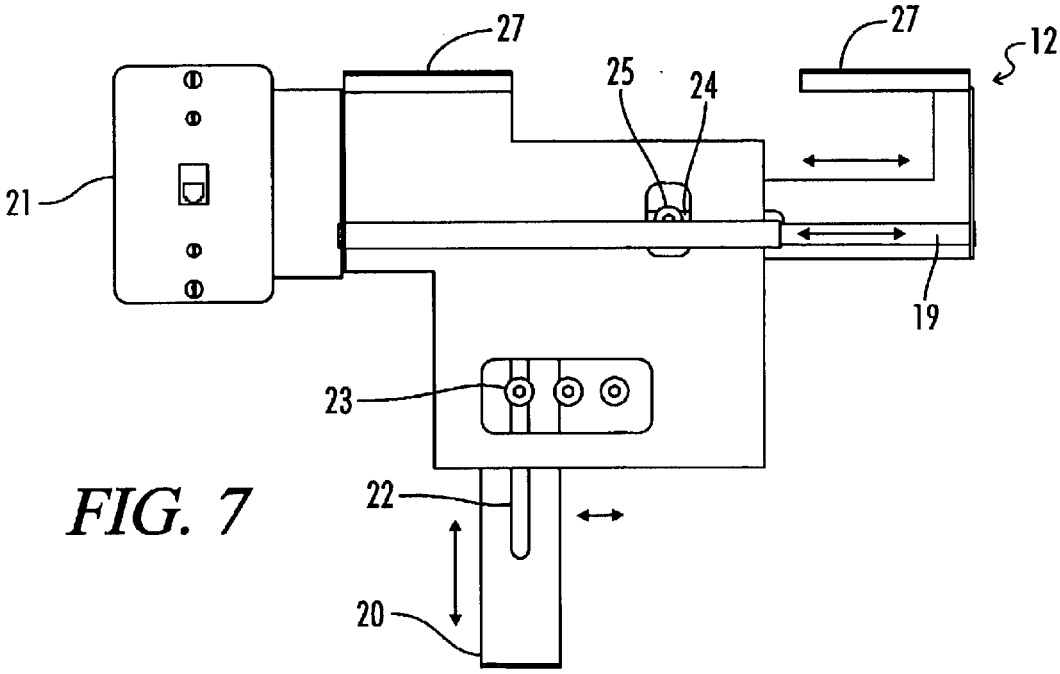
FIG. 7 is a top isometric view of the computer holding portion shown in FIG. 6.

Referring to FIG. 7, the top view of bracket 12 may be seen including tab 20 having elongated slot 22 and nut and bolt assembly 23 and an adjustable slot 24 and nut and bolt assembly 25. The width of bracket 12 and retailng rod 19 control the degree to which portable computers are secured in bracket 12 may be opened so as to usably present the screen of the portable computer to the user and to provide a secure backing or support for the screen of the portable computer.

Figure 8:
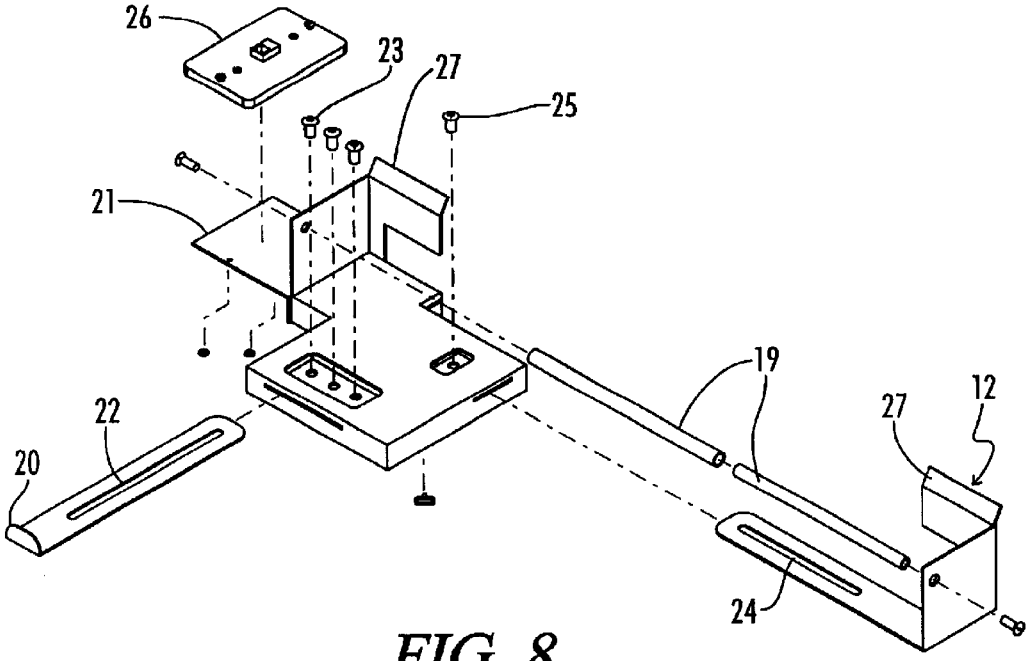
FIG. 8 is an exploded view of the computer holding portion shown in FIG. 6.

Referring to FIG. 8, an exploded view of bracket 12 is shown including tab 20, with elongated slot 22, elongated slot 24, adjustable retaining rod 19, nut and bolt assemblies 23 and 25, attachable telephone platform 21, telephone jack plate 26 and a pair of flanges 27.

Figure 9:
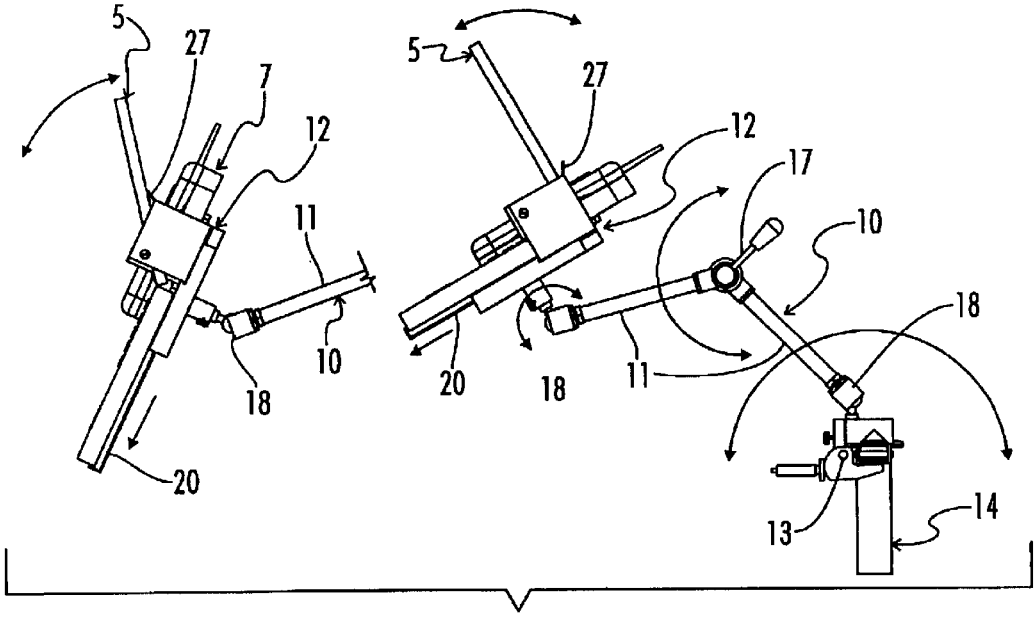
FIG. 9 is a side view of an upper portion of the computer support apparatus of the invention with computer supported therein, showing certain ranges of motion.

Referring to FIG. 9, the forward and backward rotation axes of the system of the invention are shown, including the degree to which portable computer 6 can be opened. The upper or screen portion of portable computer 5 may be rotated away from the lower or keyboard portion until the upper portion touches flange 27. Articulated arm 10 may be rotated around in any or all of 3 axes of motion that run perpendicular to the degree of opening of portable computer 5 and through the pivot points of knuckle joint 17 and each of ball-and-socket joints 18.

Figure 10:
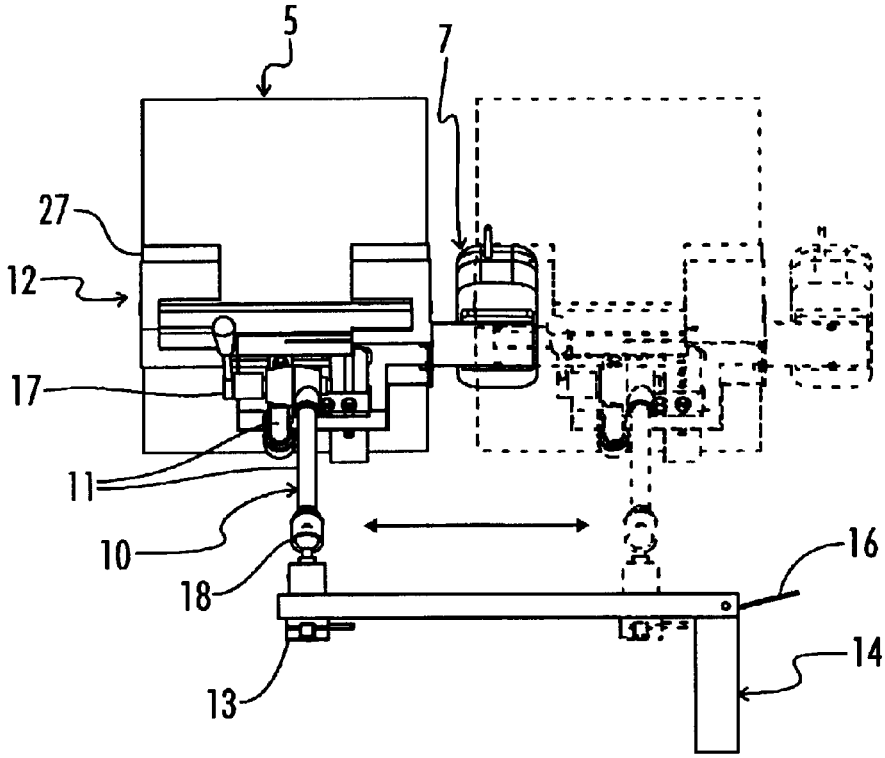
FIG. 10 is a rear view of an upper portion of the computer support apparatus of the invention with computer supported therein, showing horizontal adjustability.

Referring to FIG. 10, lateral adjustment positions are illustrated as options for adjusting the lateral position of portable computer 5 with respect to base 14. Lateral adjustments are be made by loosening, adjusting, and tightening clamp 13 to the top of the base 14 until the desired positioning is achieved.

Figure 11:
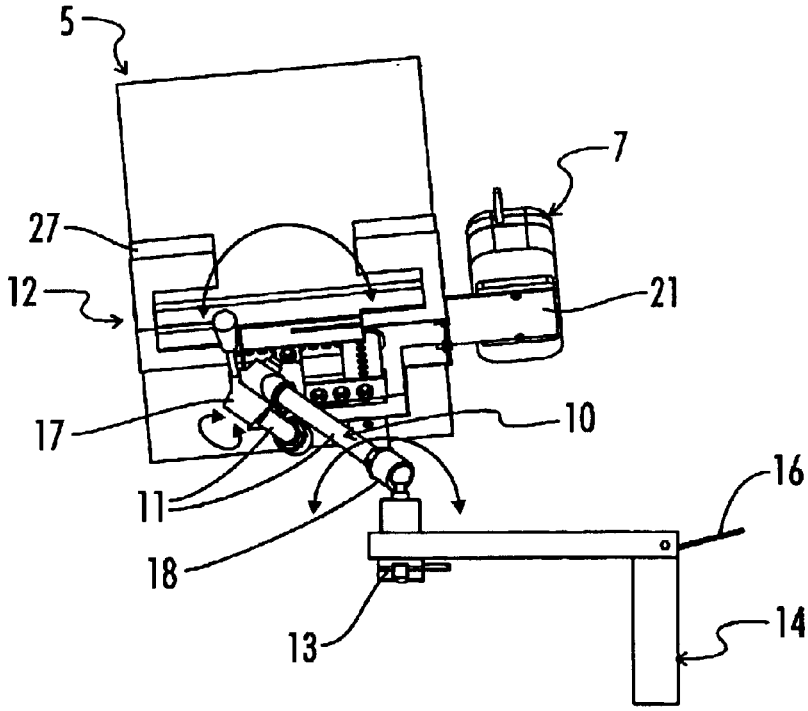
FIG. 11 is another view of FIG. 10, showing rotational ranges of motion.

Referring to FIG. 11, rotational motion of the system of the invention may be made around two rotational axes, namely, those axes around which ball-and-socket joints 18 are allowed to rotate, until portable computer 5 is positioned to the satisfaction of the user.

Figure 12:
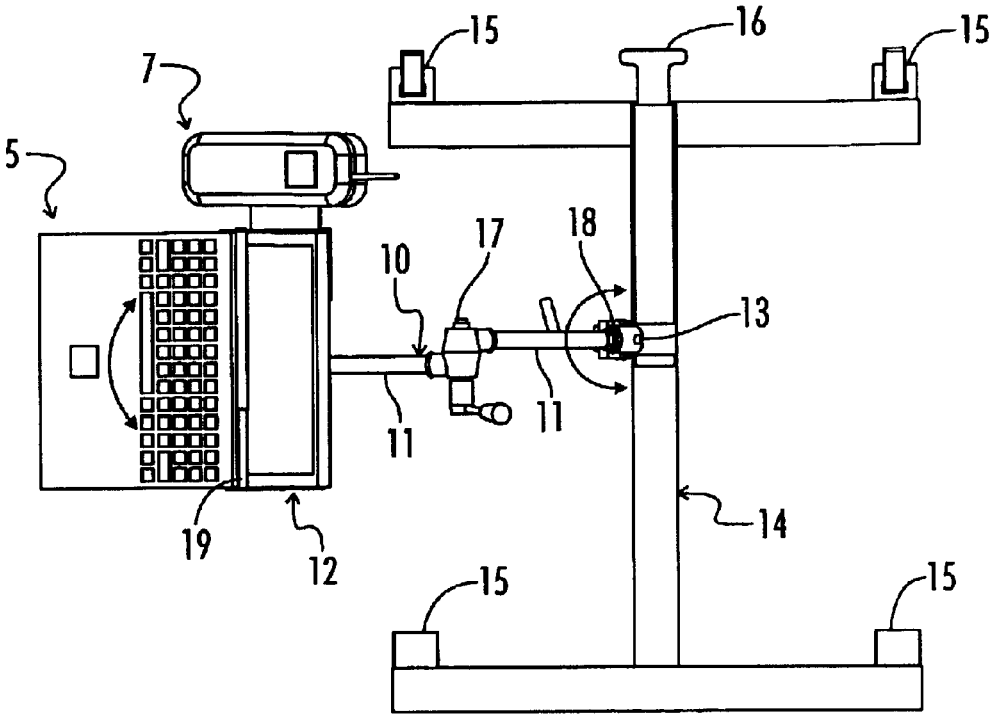
FIG. 12 is a top view of the computer support apparatus of the invention with computer supported therein, showing rotational ranges of motion.

Referring to FIG. 12, the front view of the system of the invention shows rotation of the system in a plane that is parallel to ground level. Specifically, rotation around an axis perpendicular to the ground and running through lower ball-and-socket joint 18 adjacent clamp 13 may be made to swivel articulating arm 10 and portable computer 5 to a position deemed suitable by a user.

Figure 13:
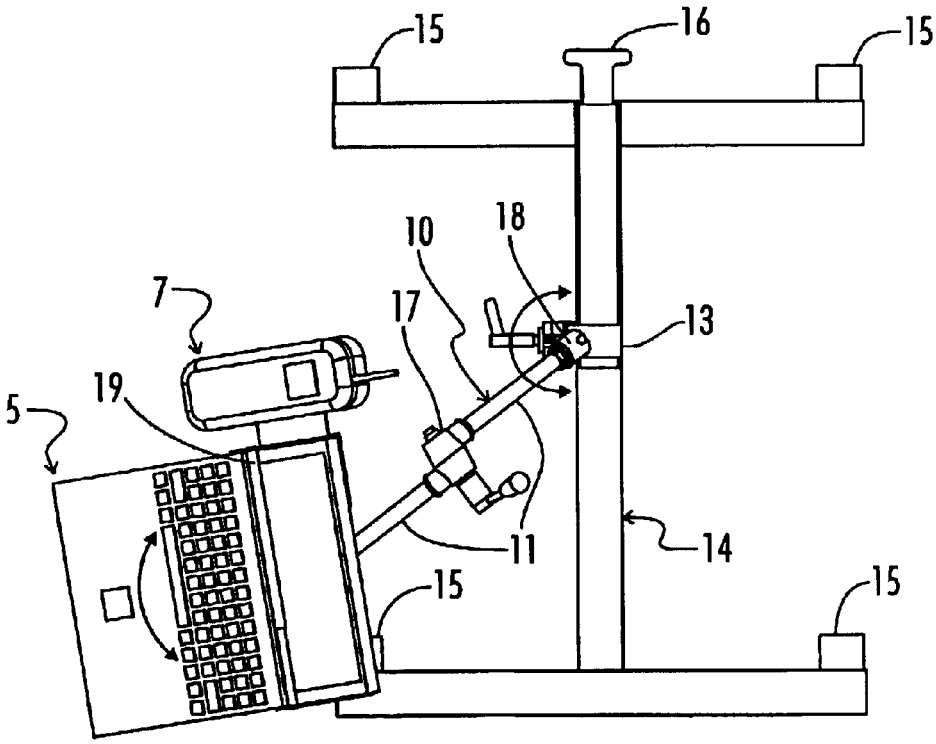
FIG. 13 is a view of FIG. 12, after the computer support apparatus is rotated in a plane.

Referring to FIG. 13, second ball-and-socket joint 18 is located adjacent bracket 12 (seen in earlier figures) may also be pivoted horizontally in the same manner as that described above relating to FIG. 12, thus allowing two axes or rotational pivot points parallel to each other and perpendicular to the ground. Each such pivot points are realized as ball-and-socket joints 18 are rotated around an axis running through each of said ball-and-socket joints 18 and perpendicular to the ground.

Thus, although there have been described particular embodiments of the present invention of a new and useful Computer Support Apparatus and Method, it is not intended that such references be construed as limitations upon the scope of this invention except as set forth in the following claims.

I claim:

1. A computer support apparatus, comprising:

a mobile base;

a computer support assembly, the computer support assembly having a base portion, a width support structure partially enclosed by and extending outward from the base portion, a length support structure partially enclosed by and extending outward from the base portion, and a retaining structure connected to the base portion and the width support structure;

an adjustable arm assembly connected to the base and the computer support assembly; and wherein the base portion includes a base wall extending outward from one side of the base portion, the wall having a base cut out portion and a base flanged portion;

the width support structure includes a width support structure wall extending outward from one side of the width support structure and a width support structure slot extending along a length of the width support structure, the width support structure wall having a width support structure cut out portion and a width support structure flanged portion; and the length support structure includes a tab on one end of the length support structure and a length support structure slot extending along a length of the length support structure.

2. The computer support apparatus of claim 1, wherein:

the base portion includes a length adjustment guide and a length adjustment fastening assembly; and a portion of the length support structure is inserted into the length adjustment guide and adjustably connected to the base portion using the length adjustment fastening assembly.

3. The computer support apparatus of claim 1, wherein:

the base portion includes a width adjustment guide and a width adjustment fastening assembly; and a portion of the width support structure is inserted into the width adjustment guide and adjustably connected to the base portion using the width adjustment fastening assembly.

4. The computer support apparatus of claim 1, wherein the base portion includes a telephone connection assembly.

5. The computer support apparatus of claim 1, wherein the arm assembly is adapted to be clamped to the base.

6. The computer support apparatus of claim 1, wherein the mobile base includes a hospital tray base.

7. The computer support apparatus of claim 1, wherein:

the base portion is an open-sided enclosure that includes a length adjustment slot defined in a front portion of the base portion and a width adjustment slot defined in a side portion of the base portion;

the width support structure extends outward from the base portion by passing through the width adjustment slot; and the length support structure extends outward from the base portion by passing through the length adjustment slot.

8. A computer support structure, comprising:

a base, the base being box-shaped and including length adjustment slots defined in a front side and a back side of the base and a width adjustment slot defined in a side of the base;

an elongated width support structure partially inserted into the width adjustment slot and adjustably connected to the base;

an elongated length support structure partially inserted into one of the length adjustment slots and adjustably connected to the base;

an adjustable retaining assembly connected to the base and the elongated width support structure; and wherein:

the base includes a base wall extending outward from one side of the base, the base wall having a base cut out portion and a base flanged portion;

the elongated width support structure includes a width support structure wall extending outward from one side of the base, the width support structure wall having a width support structure cut out portion and a width support structure flanged portion; and the elongated length support structure includes a tab on one end and a length support structure slot extending along a portion of the elongated length support structure.

9. The computer support structure of claim 8, wherein:

the base includes a length adjustment assembly;

the length adjustment assembly includes a length adjustment guide and a length adjustment fastening assembly;

a portion of the elongated length support structure is inserted into the length adjustment guide and adjustably connected to the base using the length adjustment fastening assembly;

the base includes a width adjustment assembly;

the width adjustment assembly including a width adjustment guide and a width adjustment fastening assembly; and a portion of the elongated width support structure is inserted into the width adjustment guide and adjustably connected to the base using the width adjustment fastening assembly.

10. The computer support assembly of claim 8, wherein the base includes an arm connection assembly, the arm connection assembly including a cylindrical structure extending outward from one side of the base and an arm connection fastener.

* * * * *

UNITED STATES PATENT AND TRADEMARK OFFICE

CERTIFICATE OF CORRECTION

PATENT NO. : 6,796,536 B1
DATED : September 28, 2004
INVENTOR(S) : Landers Sevier, IV It is certified that error appears in the above-identified patent and that said Letters Patent is hereby corrected as shown below:

Title page,
Item [73], Assignee, should read -- EBSCO Media, Inc., Birmingham, AL (US) --

Signed and Sealed this

Twenty-second Day of March, 2005

JON W. DUDAS
*Director of the United States Patent and Trademark Office*